US006116953A

United States Patent [19]

Myer

[11] Patent Number: 6,116,953

[45] Date of Patent: Sep. 12, 2000

[54] ELECTRICAL CONNECTOR HAVING A TERMINAL POSITION ASSURANCE DEVICE

[75] Inventor: John Mark Myer, Millersville, Pa.

[73] Assignee: The Whitaker Corporation, Wilmington, Del.

[21] Appl. No.: 09/090,040

[22] Filed: Jun. 11, 1998

Related U.S. Application Data

[60] Provisional application No. 60/051,323, Jun. 30, 1997.

[51] Int. Cl.[7] ..... H01R 13/40

[52] U.S. Cl. ..... 439/595

[58] Field of Search ..... 439/595, 752, 439/744, 594

[56] References Cited

U.S. PATENT DOCUMENTS

| | | | |
|---|---|---|---|
| 4,902,247 | 2/1990 | Suzuki et al. | 439/595 |
| 4,944,688 | 7/1990 | Lundergan | 439/595 |
| 4,973,268 | 11/1990 | Smith et al. | 439/595 |
| 5,575,692 | 11/1996 | Cecil, Jr. et al. | 439/752 |
| 5,674,091 | 10/1997 | Saitoh et al. | 439/595 |
| 5,713,761 | 2/1998 | Okayasu | 439/595 |
| 5,743,762 | 4/1998 | Takahashi | 439/595 |
| 5,746,624 | 5/1998 | Ohsumi et al. | 439/595 |

*Primary Examiner*—Neil Abrams
*Assistant Examiner*—Hae Moon Hyeon

[57] ABSTRACT

The invention is directed to an electrical connector comprising a body having a contact receiving passageway with a retention arm therein for securing contacts within the passageway. A space is disposed behind the retention arm to allow deflection of the retention arm therein. The retention arm has a ramped surface disposed adjacent to the space. A terminal position assurance device has a locking arm to be received within the space to prevent the retention arm from deflecting and to secure the contacts within the passageway. If the contact is not properly seated within the passageway, the retention arm will be deflected into the space, and the locking arm of the terminal position assurance device will be deflected by the ramped surface to engage a wall of the body and prevent the terminal position assurance device from moving to the final position.

18 Claims, 1 Drawing Sheet

ELECTRICAL CONNECTOR HAVING A TERMINAL POSITION ASSURANCE DEVICE

This application claims the benefit of U.S. Provisional Application No. 60/051,323, filed Jun. 30, 1997.

FIELD OF THE INVENTION

The present invention is directed to an electrical connector having a terminal position assurance device.

BACKGROUND OF THE INVENTION

It is known to provide a terminal position assurance device for electrical connectors. One form of terminal position assurance device is used in an electrical connector having deflectable latching arms. When the contacts are inserted into such a connector, the latching arms deflect to allow passage of the contacts. When the contacts are fully inserted, the latching arms resile into their initial position and latch behind a shoulder or some other surface on the contact thereby securing the contact within the connector. A terminal position assurance device is then inserted into the connector. The terminal position assurance device has surfaces that are received into a space proximate to the latching arms. When the terminal position assurance device is in place, the surfaces prevent the latching arms from deflecting and thereby secure the contacts within the connector. A further feature of the terminal position assurance device is that the terminal position assurance device cannot be inserted into the connector unless all of the latching arms are in their normal, non-deflected position. Therefore, if one of the contacts is not properly positioned, the latching arm will be deflected and the terminal position assurance device will be prevented from being inserted into the connector.

When the latching arms are deflected because a contact is not properly inserted into the passage, the terminal position assurance device will typically stub on the latching arm, thereby preventing insertion of the terminal position assurance device. One problem that exists because of this arrangement is that if the terminal position assurance device is pushed too hard against the latching arm, it will possibly break the latching arm thereby preventing the retention of the contact within the passageway. This becomes a problem the smaller that the connectors are made and therefore, the smaller the latching arms must be made in order to be accommodated within the connector.

What is needed is a terminal position assurance device that does not stub on the latching arm to prevent insertion of the terminal position assurance when the contacts are not properly seated within the passageway.

SUMMARY OF THE INVENTION

The invention is directed to an electrical connector comprising a body having a contact receiving passageway with a retention arm therein for securing contacts within the passageway. A space is disposed behind the retention arm to allow deflection of the retention arm therein. The retention arm has a ramped surface disposed adjacent to the space. A terminal position assurance member has a locking arm to be received within the space to prevent the retention arm from deflecting and to secure the contacts within the passageway. If the contact is not properly seated within the passageway, the retention arm will be deflected into the space, and the locking arm of the terminal position assurance member will be deflected by the ramped surface to engage a wall of the body and prevent the terminal position assurance member from moving to the final position.

The invention is further directed to an electrical connector having a housing with a contact receiving passageway with a retention arm therein for securing contacts within the passageway. A space is adjacent to the retention arm into which the retention arm will deflect during insertion or removal of the contacts. A terminal position assurance member has a locking arm. The terminal position assurance member is mounted to the housing and has a first position in which the retention arm can be deflected and a secondary position in which the locking arm is received within the space and the retention arm cannot deflect. The retention arm has a ramped surface on a front end thereof. If the retention arm is deflected into the space, when the terminal position assurance device is moved from the first position towards the second position, the locking arm will engage the ramped surface and be deflected to stub against a wall on the housing.

BRIEF DESCRIPTION OF THE DRAWINGS

An embodiment of the present invention will now be described by way of example with reference to the accompanying drawings, in which.

DETAILED DESCRIPTION OF AN EMBODIMENT OF THE INVENTION

Figure 1:
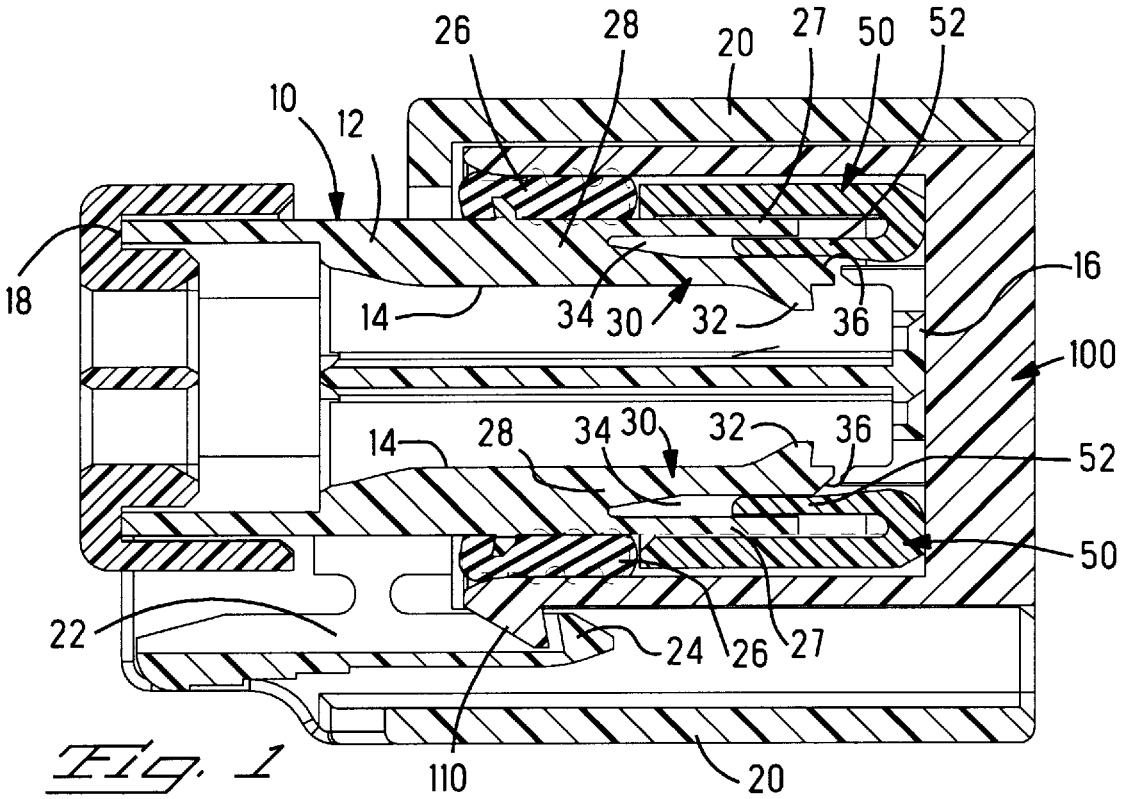
FIG. 1 is a cross sectional view showing an electrical connector having a terminal position assurance device in place and mated with a matable connector.

FIG. 1 shows a cross sectional view of an electrical connector 10 mated with a mating connector 100. The mating connector 100 is shown as a representation. The mating connector 100 will have many other features, such as contact receiving passages and contacts, which are not shown in FIG. 1. The electrical connector 10 has a housing body 12 with contact receiving passages 14 for receiving contacts therein, not shown. The electrical connector 10 has a forward mating end 16 and a rearward end 18. The electrical connector 10 further has a shroud 20 which extends around the mating end of the electrical connector 10.

Electrical connector 10 has a latching arm 22 having a latching protrusion 24. The latching arm 22 is used to latch and secure the mating connector 100 therewith. The mating connector has a complimentary latching protrusion 110 which engages with the latching protrusion 24 to secure the mating connector 100 with the electrical connector 10.

The electrical connector 10 has a seal 26 which extends around the inner portion 28 of the electrical connector within the shroud 20. When the mating connector 100 is connected with electrical connector 10, a portion of the mating connector 100 will engage the outer surface of the seal 26 thereby providing a sealing interface between the electrical connector 10 and the mating connector 100.

When the mating connector 100 is mated with the electrical connector 10, the mating connector is received within the shroud 20 and engages the seal 26, thereby forming the sealed interface. The mating connector 100 will have a series of electrical contacts secured therein to mate with the electrical contacts in the electrical connector 10, neither of these contacts being shown in FIG. 1.

Within the contact receiving passageways 14 there are contact retention arms 30. The retention arms 30 each have a latching protrusion 32 which is used to engage a shoulder on the electrical contact to secure the contact therein. Behind the retention arm 30 is a space 34 into which the retention arm 30 can deflect during insertion of the electrical contact into the contact receiving passageway 14. On the side of the retention arm 30 proximate to the space 34, towards the front end of the latching arm, there is a ramp surface 36 the purpose of which will be described hereinafter.

A terminal position assurance member (TPA) 50 is inserted from the front end or the mating end 16 of the electrical connector 10 to provide a back-up to the retention arm to lock the contacts within the electrical connector 10 and to alert the operator when a contact is improperly mounted within the electrical connector 10. The TPA 50 has a locking arm 52 which when fully inserted into the electrical connector 10, as is shown in FIG. 1, will be received within the space 34 behind the latching arm 30. When the TPA 50 is in this position, the retention arm 30 is prevented from being deflected from its normal state, thereby preventing the retention arm 30 from being dislodged from the electrical contact and allowing the electric contact to be removed from the electrical connector 10.

Figure 2:
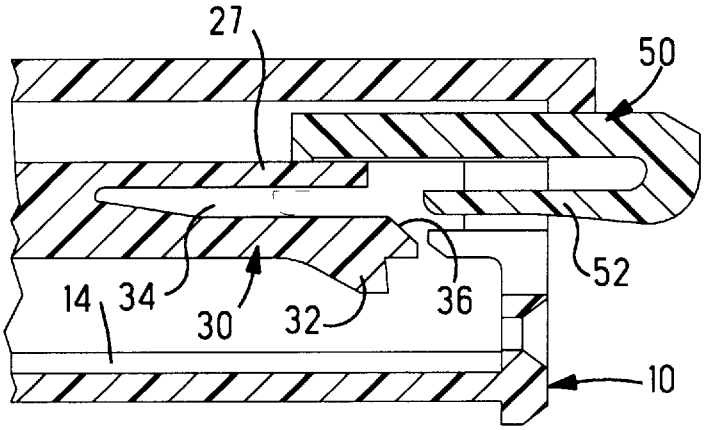
FIG. 2 shows a cross sectional view with the terminal position assurance device in a pre-latch position.

FIG. 2 shows a cross sectional view of the electrical connector 10 and the TPA 50. The TPA 50 is shown in the prelatch position that is the position in which it is prior to and during the insertion of the contacts into the contact receiving passageway 14. In this position, the retention arms 30 are in their normal position which would allow the TPA 50 to be pushed fully into the final position, as is shown in FIG. 1. This is the position the TPA 50 will be in during insertion of the electrical contacts into the contact receiving passageway 14. When the contact is inserted into the passageway and becomes fully seated in its proper position within the passageway 14, the retention arm 30 will resile to its normal position latching the shoulder on the contact, thereby securing the contact within the passageway 14 and allowing the TPA to be moved from its prelatch position to the final position.

Figure 3:
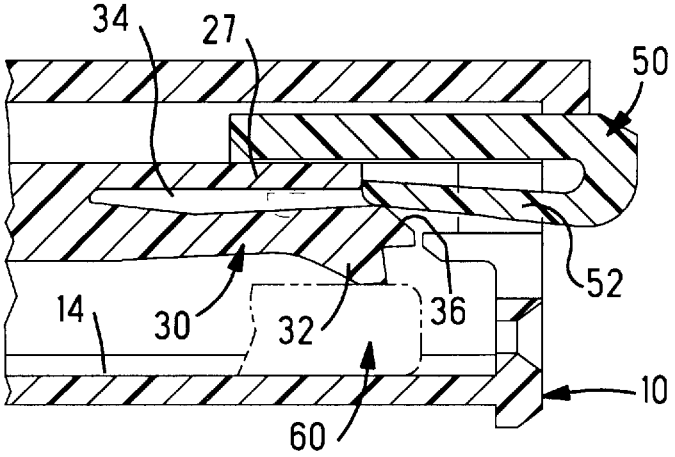
FIG. 3 shows a cross sectional view with a contact improperly seated within the passageway of the electrical connector.

If the contact 60 is not completely inserted or is improperly inserted into the passageway 14, the retention arm 30 will continue to be deflected from the contact receiving passageway 14 into the space 34, as shown in FIG. 3. Then when an attempt is made to push the TPA from the prelatch position to the final position, the locking arm 52 will engage the front end of the retention arm 30 along the ramp surface 36. The ramp surface 36 will serve to deflect the locking arm 52 upwardly, as shown in FIG. 3. When the locking arm 52 is deflected upwardly it will engage against wall 27 of the electrical connector 10. Since the locking arm 52 is engaging the wall 27, the TPA 50 will be prevented from being moved further into the electrical connector 10, or to the left as shown in FIG. 3. Therefore, it is an indication to the operator that the contacts are not properly inserted within the electrical connector 10 and this must be corrected before the TPA 50 can be fully inserted. Because the TPA 50 stubs against the wall 27 of the electrical connector 10, it is not necessary for the TPA 50 to stub against the retention latch 30, which could cause breakage of the retention latch 30. As the requirements for electrical connectors becomes smaller and smaller, the size of the retention latch 30 also becomes smaller and therefore the strength of the latch is decreased. By having the TPA stub on the housing wall 27, the retention latch 30 is protected from breakage.

Once the position of the contacts has been corrected, that is the contact is placed into the proper position, the retention arm 30 will resile to its normal position thereby releasing the engagement of the locking arm 52 against wall 27 and allowing the TPA 50 to be fully inserted within the electrical connector 10 to the final position thereby allowing the TPA 50 to act as the back-up lock to prevent the contacts from being removed from the electrical connector.

The electrical connector of the present invention and many of its attendant advantages will be understood from the foregoing description. It is apparent that various changes may be made in the form, construction, and an arrangement of parts thereof without departing from the spirit or scope of the invention or sacrificing all of its material advantages.

What is claimed is:

1. An electrical connector comprising a body having a contact receiving passageway with a retention arm therein for securing contacts within the passageway, a space being disposed behind the retention arm to allow deflection of the retention arm therein, the retention arm having a ramped surface disposed adjacent to the space, a terminal position assurance device having a deflectable locking arm to be received within the space to prevent the retention arm from deflecting and to secure the contacts within the passageway, whereby if the contact is not properly seated within the passageway, the retention arm will be deflected into the space, the locking arm of the terminal position assurance device will be deflected by the ramped surface to engage a wall of the electrical connector and prevent the terminal position assurance device from moving to the final position without damaging the retention arm.

2. The electrical connector of claim 1, wherein the wall extends along the space opposite to the retention arm.

3. The electrical connector of claim 2, wherein the wall forms an outer wall of an inner portion of the electrical connector.

4. The electrical connector of claim 3, wherein a shroud extends around the inner portion.

5. The electrical connector of claim 4, wherein a seal member is disposed about the inner portion to engage the mating connector and provide a sealing interface.

6. The electrical of claim 1, wherein the connector has a latching arm to engage and secure the mating connector.

7. The electrical connector of claim 1, wherein the ramped surface is disposed along the forward end of the retention arm.

8. The electrical connector of claim 7, wherein the retention arm has a protrusion for engaging the contact, the ramped surface being disposed opposite the latching protrusion.

9. The electrical connector of claim 1 wherein the ramped surface is on the front end of the retention arm and extends forward and beyond a front edge of a wall, on the opposite side of the space, engaged by the terminal position assurance device locking arm when deflected by the ramped surface.

10. An electrical connector having a housing with a contact receiving passageway with a retention arm therein for securing a contact within the passageway, a space adjacent to the retention arm into which the retention arm will deflect during insertion or removal of the contacts, a terminal position assurance device having a deflectable locking arm, the terminal position assurance device being mounted to the housing and having a first position in which the retention arm can be deflected and a secondary position in which the locking arm is received within the space and the retention arm cannot deflect, the retention arm having a ramped surface on a front end thereof, if the retention arm is deflected into the space, when the terminal position assurance device is moved from the first position towards the second position, the deflectable locking arm will engage the ramped surface and be deflected to stub against a wall on the housing to prevent damage to the retention arm.

11. The electrical connector of claim 10, wherein the wall extends along the space opposite to the retention arm.

12. The electrical connector of claim 11, wherein the wall forms an outer wall of an inner portion of the electrical connector.

13. The electrical connector of claim 12, wherein a shroud extends around the inner portion.

14. The electrical connector of claim 13, wherein a seal member is disposed about the inner portion to engage the mating connector and provide a sealing interface.

15. The electrical of claim 10, wherein the connector has a latching arm to engage and secure the mating connector.

16. The electrical connector of claim 10, wherein the ramped surface is disposed along the forward end of the retention arm.

17. The electrical connector of claim 16, wherein the retention arm has a protrusion for engaging the contact, the ramped surface being disposed opposite to the latching protrusion.

18. The electrical connector of claim 10 wherein the ramped surface on the front end of the retention arm extends forward and beyond a front edge of the wall engaged by the terminal position assurance device locking arm when deflected by the ramped surface.

* * * * *